US008037799B2

(12) United States Patent
Gaigler et al.

(10) Patent No.: US 8,037,799 B2
(45) Date of Patent: Oct. 18, 2011

(54) THERMAL MANAGEMENT FOR ELECTROMAGNETIC COIL SYSTEMS

(75) Inventors: Randy L. Gaigler, Parkville, MD (US); Jimmy C. Tong, Washington, DC (US)

(73) Assignee: Lockheed Martin Corporation, Bethesda, MD (US)

( * ) Notice: Subject to any disclaimer, the term of this patent is extended or adjusted under 35 U.S.C. 154(b) by 386 days.

(21) Appl. No.: 12/040,710

(22) Filed: Feb. 29, 2008

(65) Prior Publication Data

US 2009/0219697 A1 Sep. 3, 2009

(51) Int. Cl.
*F41F 1/00* (2006.01)

(52) U.S. Cl. ..... 89/8; 89/1.8; 219/618; 219/632; 165/58

(58) Field of Classification Search ..... 89/8, 1.8; 219/618, 632; 165/58
See application file for complete search history.

(56) References Cited

U.S. PATENT DOCUMENTS

| | | | | |
|---|---|---|---|---|
| 3,538,366 | A * | 11/1970 | Glien Hans et al. | 313/24 |
| 4,967,639 | A * | 11/1990 | Hughes et al. | 89/8 |
| 5,217,948 | A * | 6/1993 | Leung et al. | 124/3 |
| 5,813,234 | A * | 9/1998 | Wighard | 62/6 |
| 2008/0053299 | A1 * | 3/2008 | Taylor | 89/8 |
| 2008/0141939 | A1 * | 6/2008 | Gillard et al. | 118/723 MA |

* cited by examiner

*Primary Examiner* — Troy Chambers
*Assistant Examiner* — Samir Abdosh
(74) *Attorney, Agent, or Firm* — Schwegman, Lundberg & Woessner, P.A.

(57) ABSTRACT

A system includes a housing and an electromagnetic coil within the housing. The electromagnetic coil is arranged in a coil stack. A thermal damper is positioned adjacent to the electromagnetic coil, and a thermal structural plate is positioned adjacent to the coil stack. The thermal damper manages temperature rise of the electromagnetic coil and the thermal structural plate provides cooling to the coil stack. In an embodiment, the system is used to launch projectiles.

14 Claims, 4 Drawing Sheets

THERMAL MANAGEMENT FOR ELECTROMAGNETIC COIL SYSTEMS

TECHNICAL FIELD

Various embodiments relate to electromagnetic coil systems, and in an embodiment, but not by way of limitation, to thermal management of the electromagnetic coils in such systems, and in particular, the coils in electromagnetic launch systems.

BACKGROUND

Electromagnetic launch systems employ electromagnetic coils to launch projectiles from a launch tube, canister, or other supporting structure. A typical cross section of an electromagnetic launch structure consists of an inner shell, several axial coil spacers and electromagnetic coils, a potting system, and an outer shell.

Current electromagnetic launch systems are limited in repetition rate capability due to the temperature rise of the coil during launch. After a certain number of launches, the temperature of the coil exceeds the thermal properties of the magnetic wire and the thermal energy becomes entrapped within the coil.

DETAILED DESCRIPTION

Figure 1:
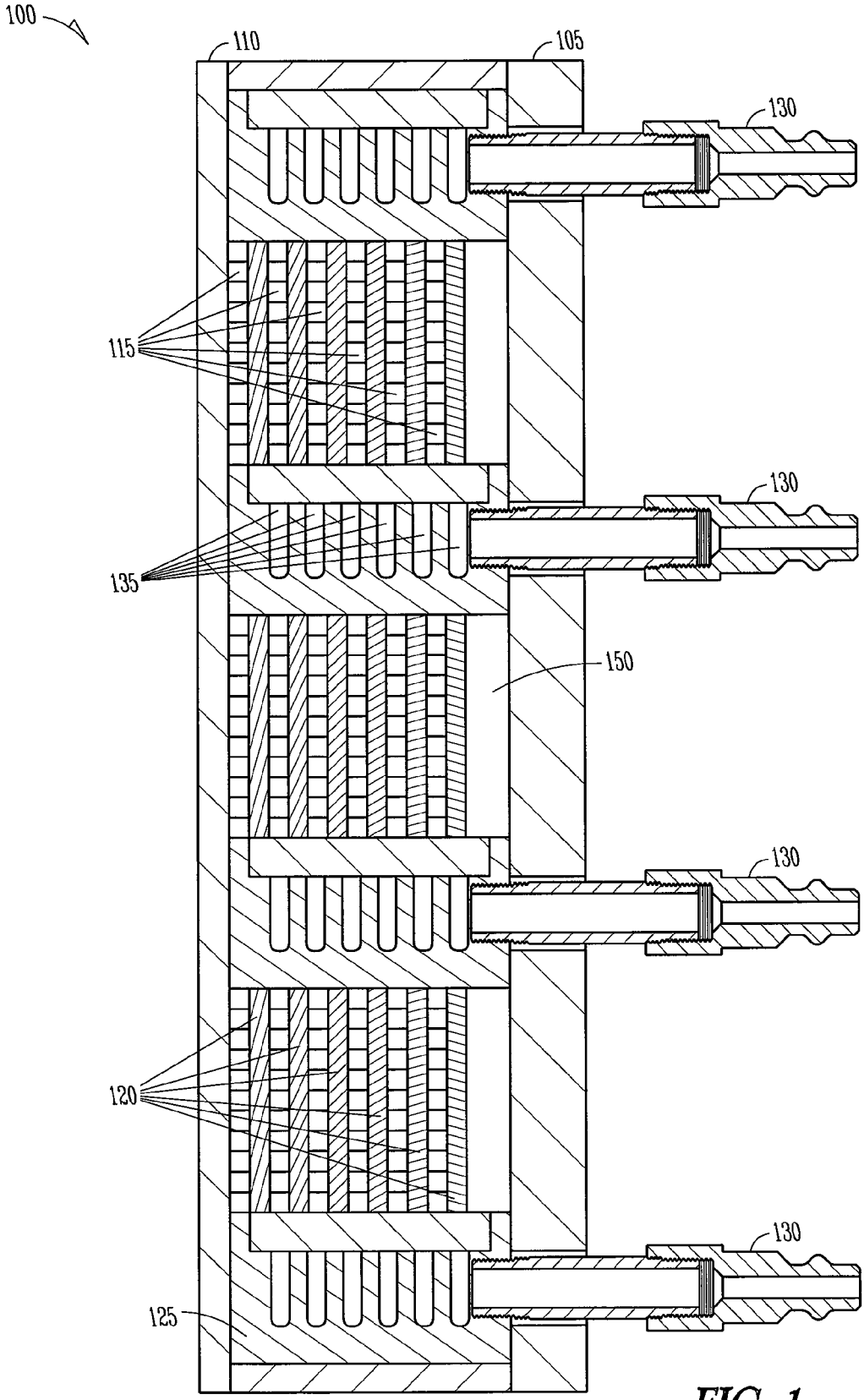
FIG. 1 illustrates an example embodiment of a thermal management system for an electromagnetic coil system.

In the following detailed description, reference is made to the accompanying drawings that show, by way of illustration, specific embodiments in which the invention may be practiced. These embodiments are described in sufficient detail to enable those skilled in the art to practice the invention. It is to be understood that the various embodiments of the invention, although different, are not necessarily mutually exclusive. Furthermore, a particular feature, structure, or characteristic described herein in connection with one embodiment may be implemented within other embodiments without departing from the scope of the invention. In addition, it is to be understood that the location or arrangement of individual elements within each disclosed embodiment may be modified without departing from the scope of the invention. The following detailed description is, therefore, not to be taken in a limiting sense, and the scope of the present invention is defined only by the appended claims, appropriately interpreted, along with the full range of equivalents to which the claims are entitled. In the drawings, like numerals refer to the same or similar functionality throughout the several views.

In an embodiment, an electromagnetic launch system includes thermal dampers between the magnetic coil layers and thermal structural plates on the top and bottom surfaces of the magnetic coil. The thermal dampers absorb the initial temperature rise of the coil during pulsing and the thermal structural plates provide a means to remove the thermal energy from the coil. The thermal dampers can be sized for optimal thermal capacitance, magnetic permeability, and electrical resistance, can be made out of aluminum, stainless steel, or other material with a high heat capacity, and can be added to the coil during the coil winding process.

The thermal structural plates can be used to obtain the appropriate coil to coil spacing, can be utilized as an internal heat sink for cooling, and can be designed to endure structural loading. The thermal structural plates have inlet and outlet ports that allow for fluid to flow around the internal heat sink for cooling. The fluid can either be re-circulated or simply vented to the environment during the cooling process. Both the thermal dampers and thermal structural plates can be segmented and separated with a dielectric to minimize eddy current effects when electrically conducting materials are chosen. In another embodiment, an air plenum can be used between one or more of the coil stacks instead of the thermal structural plates. The thermal structural plates can be made of a hardened steel or other structurally sound material.

FIG. 1 illustrates an apparatus including an electromagnetic coil system 100. In an embodiment, such a system can be an electromagnetic coil projectile launch system. The electromagnetic coil system 100 includes an outer shell 105 and an inner shell 110. A plurality of magnetic wires 115 is positioned within the outer and inner shells. Placed between the magnetic wires 115 are thermal dampers 120. As noted above, the thermal dampers 120 can be made out of stainless steel, aluminum, or other material with a high heat capacity. A potting system 150 can be used to embed the magnetic wires 115 and thermal dampers 120 within the outer shell 105 and the inner shell 110 of the system 100.

FIG. 1 further illustrates a thermal structural plate 125. The thermal structural plate 125 can be positioned between coil stacks. A pipe 130 is coupled to the thermal structural plate 125, and provides fluid to channels 135 within the structural plate 125. The thermal dampers 120 manage temperature rise of the magnetic wires 115, and the thermal structural plates 125 provide cooling to the coil stack.

If the electromagnetic coil system 100 is an electromagnetic coil projectile launching system, the thermal dampers 120 manage heating during coil pulsing. The thermal structural plates 125 are located between the coil stacks to remove heat from the system after pulsing and to provide structural support to the coil.

Figure 2A:
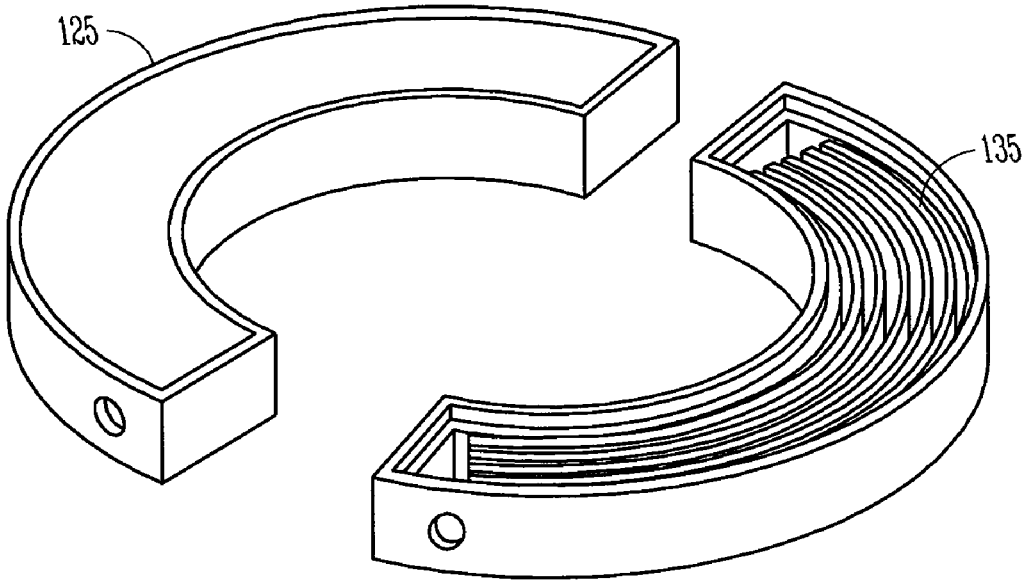
FIGS. 2A and 2B illustrate example embodiments of a thermal structural plate of a thermal management system.
Figure 2B:
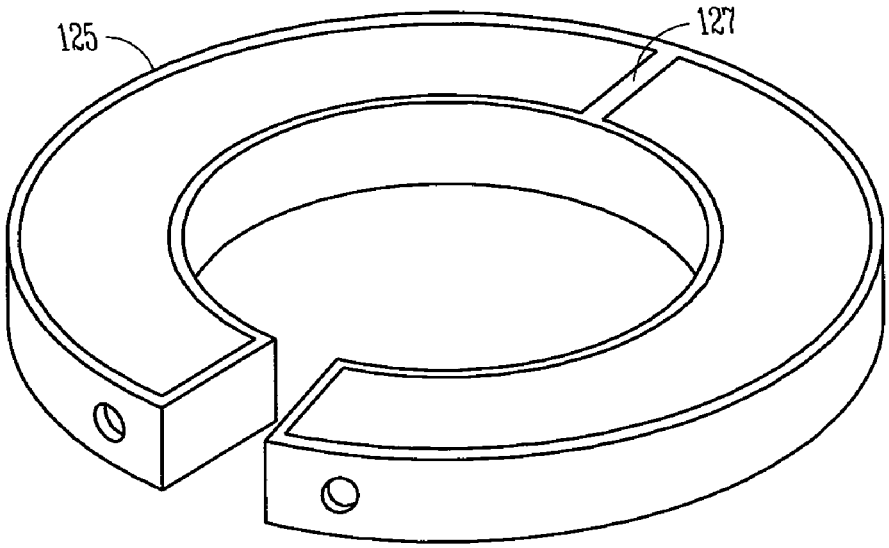

FIGS. 2A and 2B illustrate embodiments of a thermal structure plate 125. As illustrated in FIG. 2A, a thermal structural plate 125 includes a plurality of channels 135 that receive a fluid to cool the magnetic coils 115. The fluid is supplied to the thermal structural plate 125 via the pipe 130, and is removed from the thermal structural plate 125 via a return pipe (not illustrated in FIG. 2A). When two halves of a thermal structural plate 125 are fitted together for installation in a thermal control system, a Kapton® tape 127 (or other tape or dielectric material that has similar electrical, thermal, chemical and mechanical properties) can be added at the split as shown in FIG. 2B. The Kapton® tape 127 helps to isolate inducted eddy currents.

Figure 3:
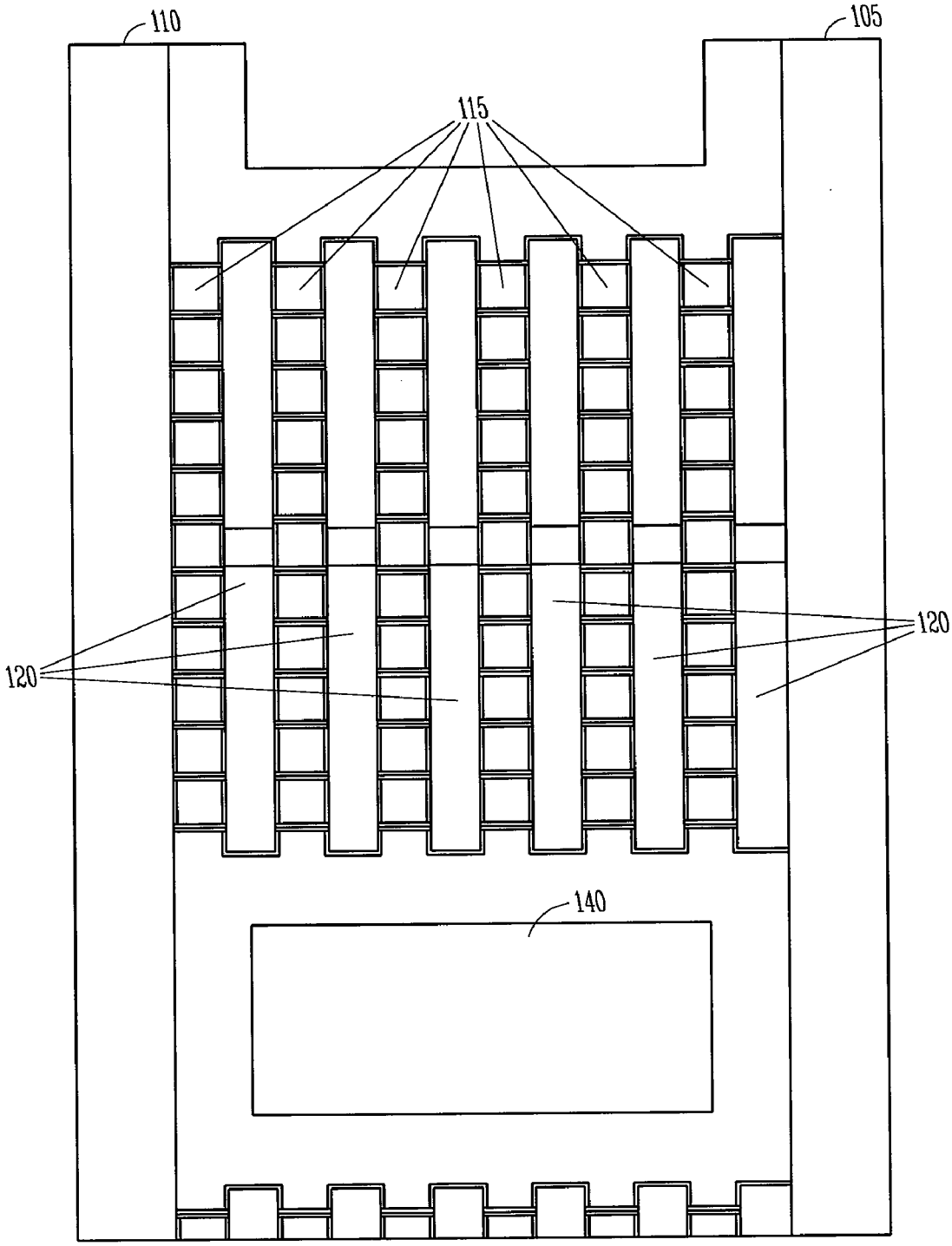
FIG. 3 illustrates an example embodiment of an electromagnetic coil stack with a plenum positioned adjacent to the coil stack.

FIG. 3 illustrates an example embodiment of a coil stack with a plenum 140 positioned between the coil stacks. Air can be circulated through the plenum 140 to remove heat from the coil stacks.

Figure 4:
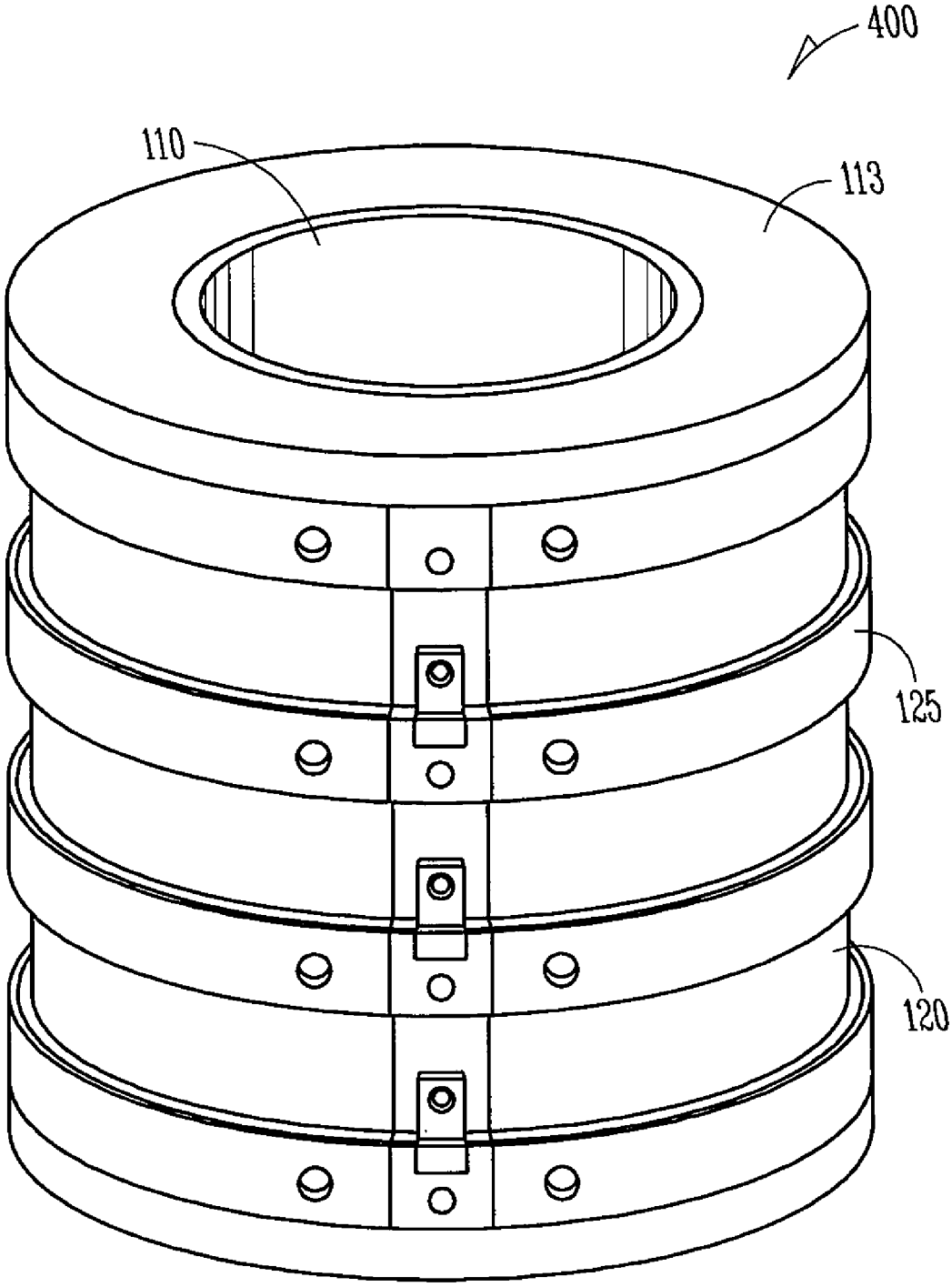
FIG. 4 illustrates another example embodiment of an electromagnetic coil stack.

FIG. 4 illustrates another example embodiment of a coil stack 400. The coil stack 400 includes a plurality of magnetic coil wires (not visible in FIG. 4) that are covered by an outer thermal damper 120 and separated by thermal structural plates 125. An insulator flange 113 and an inner shell 110 are also visible in FIG. 4.

Thus, an example thermal management system for electromagnetic coils, and in particular, electromagnetic launch coils, has been described. Although specific example embodiments have been described, it will be evident that various modifications and changes may be made to these embodiments without departing from the broader scope of the invention. Accordingly, the specification and drawings are to be regarded in an illustrative rather than a restrictive sense. The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract is provided to comply with 37 C.F.R. §1.72(b) and will allow the reader to quickly ascertain the nature and gist of the technical disclosure. It is submitted with the understanding that it will not be used to interpret or limit the scope or meaning of the claims.

In the foregoing description of the embodiments, various features are grouped together in a single embodiment for the purpose of streamlining the disclosure. This method of disclosure is not to be interpreted as reflecting that the claimed embodiments have more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate example embodiment.

What is claimed is:

1. A system comprising:

a housing;

a plurality of electromagnetic coil layers within the housing, the plurality of electromagnetic coil layers concentrically arranged about a central axis of the housing such that a first concentric electromagnetic coil layer is proximate to an inner shell of the housing, such that a second concentric electromagnetic coil layer is proximate to an outer shell of the housing, and such that a third concentric electromagnetic coil layer is positioned between the first concentric electromagnetic coil layer and the second concentric electromagnetic coil layer, wherein the first concentric electromagnetic coil layer is positioned at a first distance from the central axis, the second electromagnetic coil layer is positioned at a second distance from the central axis, and the third electromagnetic coil layer is positioned at a third distance from the central axis, wherein the first distance is less than the third distance, and the third distance is less than the second distance, wherein the plurality of electromagnetic coil layers is vertically arranged to form one or more coil stacks;

a plurality of thermal dampers positioned between the electromagnetic coil layers, the plurality of thermal dampers concentrically arranged about the central axis of the housing, the thermal dampers comprising one or more of steel and aluminum; and a thermal structural plate positioned between a bottom portion of a first coil stack and a top portion of a second coil stack;

wherein the system comprises an electromagnetic projectile launching system.

2. The system of claim 1, wherein the thermal structural plate comprises a hardened steel or other structural material.

3. The system of claim 1, wherein the thermal structural plate comprises a fluid channel.

4. The system of claim 1, wherein the thermal structural plate comprises a material to isolate inducted eddy currents in the thermal structural plate.

5. The system of claim 4, wherein the material to isolate inducted eddy currents comprises a dielectric material.

6. The system of claim 1, comprising a plenum positioned between the one or more coil stacks.

7. A system comprising:

a housing;

an electromagnetic coil within the housing, the electromagnetic coil concentrically arranged about a central axis of the housing such that a first concentric electromagnetic coil section is proximate to an inner shell of the housing, such that a second concentric electromagnetic coil section is proximate to an outer shell of the housing, and such that a third concentric electromagnetic coil section is positioned between the first concentric electromagnetic coil section and the second concentric electromagnetic coil section, wherein the first concentric electromagnetic coil section is positioned at a first distance from the central axis, the second electromagnetic coil section is positioned at a second distance from the central axis, and the third electromagnetic coil section is positioned at a third distance from the central axis, wherein the first distance is less than the third distance, and the third distance is less than the second distance, wherein the electromagnetic coil is vertically arranged to form a coil stack;

a thermal damper positioned between the sections of the electromagnetic coil, the thermal damper concentrically arranged about the central axis of the housing; and a thermal structural plate positioned between a bottom portion of a first coil stack and a top portion of a second coil stack;

wherein the system comprises an electromagnetic projectile launching system.

8. The system of claim 7, wherein the thermal structural plate comprises a hardened steel or other structural material.

9. The system of claim 7, wherein the thermal structural plate comprises a fluid channel.

10. The system of claim 7, wherein the thermal structural plate comprises a material to isolate inducted eddy currents in the thermal structural plate.

11. The system of claim 10, wherein the material to isolate inducted eddy currents comprises a dielectric material.

12. The system of claim 7, comprising a plenum positioned between the coil stack and a second coil stack.

13. The system of claim 1, wherein the electromagnetic coil layers and the thermal dampers are in contact.

14. The system of claim 7, wherein the electromagnetic coil and the thermal damper are in contact.

* * * * *